US007207246B2

(12) United States Patent
Hu

(10) Patent No.: US 7,207,246 B2
(45) Date of Patent: Apr. 24, 2007

(54) SCREWDRIVER WITH SCREWDRIVER HEAD STORAGE STRUCTURE

(76) Inventor: Hung-Ming Hu, No. 205-1, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 42 days.

(21) Appl. No.: 11/127,123

(22) Filed: May 12, 2005

(65) Prior Publication Data

US 2006/0254396 A1 Nov. 16, 2006

(51) Int. Cl.
*B25B 23/16* (2006.01)
*B25G 1/08* (2006.01)

(52) U.S. Cl. ..... 81/177.4; 81/490

(58) Field of Classification Search ..... 81/177.4, 81/490, 492, 489, 427.5; 16/111.1
See application file for complete search history.

(56) References Cited

U.S. PATENT DOCUMENTS 5,265,504 A * 11/1993 Fruhm ..... 81/439
5,499,562 A * 3/1996 Feng ..... 81/177.4
5,675,866 A * 10/1997 Tseng ..... 16/111.1
6,305,815 B1 * 10/2001 Lin ..... 362/119
6,502,484 B2 * 1/2003 Pao-Hsi ..... 81/439
2004/0025650 A1 * 2/2004 Hu ..... 81/490
2004/0094000 A1 * 5/2004 Liao ..... 81/490
2004/0139831 A1 * 7/2004 Nagy ..... 81/490

FOREIGN PATENT DOCUMENTS

EP 312775 A1 * 4/1989

* cited by examiner

*Primary Examiner*—Joseph J. Hail, III
*Assistant Examiner*—Bryan R. Muller
(74) *Attorney, Agent, or Firm*—Rosenberg, Klein & Lee

(57) ABSTRACT

A screwdriver with screwdriver head storage structure includes a handle, a receiving unit, a clamping device and a sliding cover. The handle comprises a compartment therein. The compartment is provided with a pair of connecting blocks at respective ends. The connecting blocks comprise troughs to connect with the receiving unit. The receiving unit comprises a plurality of recesses to accommodate screwdriver heads therein. The handle and the sliding cover comprises a pair of sliding sections, respectively, to engage with each other, so that the sliding cover is able to slide in relation to the handle so as to hide screwdriver heads within the handle.

2 Claims, 4 Drawing Sheets

SCREWDRIVER WITH SCREWDRIVER HEAD STORAGE STRUCTURE

BACKGROUND OF THE INVENTION

1. Field of the Invention

The present invention relates to a screwdriver, more particularly, to a screwdriver handle having a compartment to accommodate a receiving unit so as to store screwdriver heads therein.

2. Description of the Related Prior Art

A conventional screwdriver is designed to exchange screwdriver heads for different purposes. Those screwdriver heads are compact in size. Due to the compact size of the screwdriver with a storage compartment in the handle was derived, as shown in FIG. 4, which comprises a front handle A. The front handle A comprises a compartment A1 therein to receive a rear handle A2. The rear handle Ad2 comprises a number of recesses A3 to store screwdriver heads B. This design increases the weight of the handle and the cost of manufacture. Furthermore, in order to store and to use the screwdriver heads, the rear handle A2 has to be opened entirely, which may cause other screwdriver heads to drop off accidentally.

SUMMARY OF THE INVENTION it is the primary object of the present invention to provide a screwdriver with screwdriver head storage structure, which is convenient to store and to pick screwdriver heads, and is convenient to carry.

It is another object of the present invention to provide a screwdriver with screwdriver head storage structure, which redesigns the original handle to accommodate screwdriver heads therein without changing the shape of the screwdriver's handle.

It is a further object of the present invention to provide a screwdriver with screwdriver head storage structure, which is easy to pick a desired screwdriver head without worrying other heads to drop off.

DETAILED DESCRIPTION OF THE PREFERRED EMBODIMENT

Figure 1:
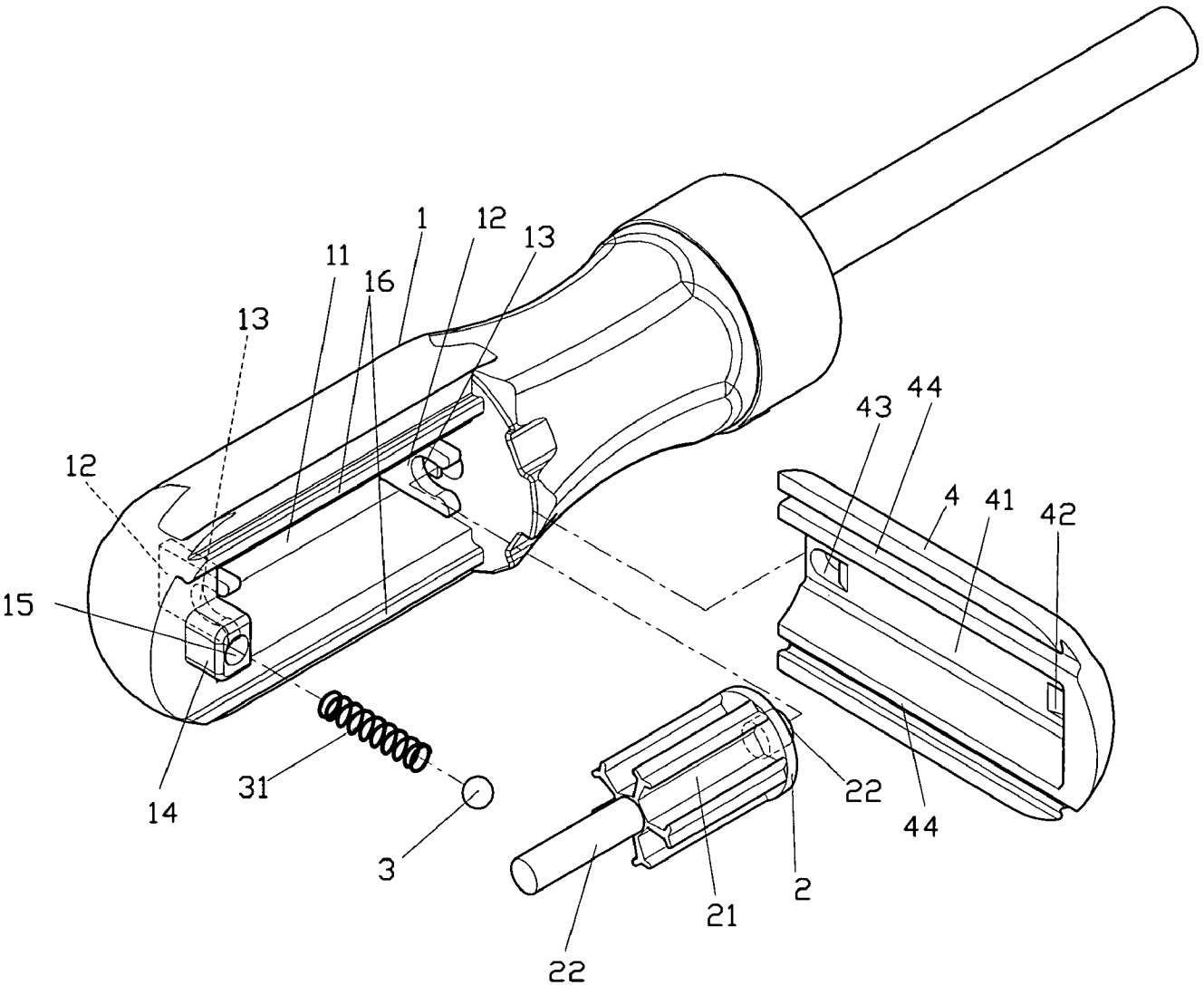
FIG. 1 is an exploded view of the present invention.

As shown in FIG. 1, the present invention comprises a handle 1, a receiving unit 2, a clamping device 3 and a sliding cover 4.

The handle 1 comprises a compartment 11 therein. The compartment 11 comprises a pair of connecting block 12 at respective ends. Each connecting block 12 has a trough 12. The compartment 11 is provided with a locator 14 protruding from one inner end. The locator 14 has a blind hole 15. The handle 1 further comprises a pair of first sliding sections 16 at respective sides of the compartment 11. In this embodiment, the sliding sections 16 are sliding blocks.

The receiving unit 2 is engaged with the two troughs 13 of the connecting blocks 12 of the handle 1 to rotate. The receiving unit 2 comprises a plurality of recesses 21 around the circumference of the receiving unit 2 and a pair of stems 22 extending from respective ends.

The clamping device 3 is placed in the blind hole 15 of the locator 14. The clamping device 3 is formed with a ball bearing urged by an elastic element 31.

The sliding cover 4 is slid on the first sliding sections 16 of the handle 1 to close or open the compartment 11. The sliding cover 4 comprises a slot 41 at the inner edge a pair of locating holes 42 and 43 at the front and rear ends, respectively, and a pair of second sliding sections 44 formed at respective sides of the slot 41. The second sliding sections 44 are sliding troughs.

Figure 2:
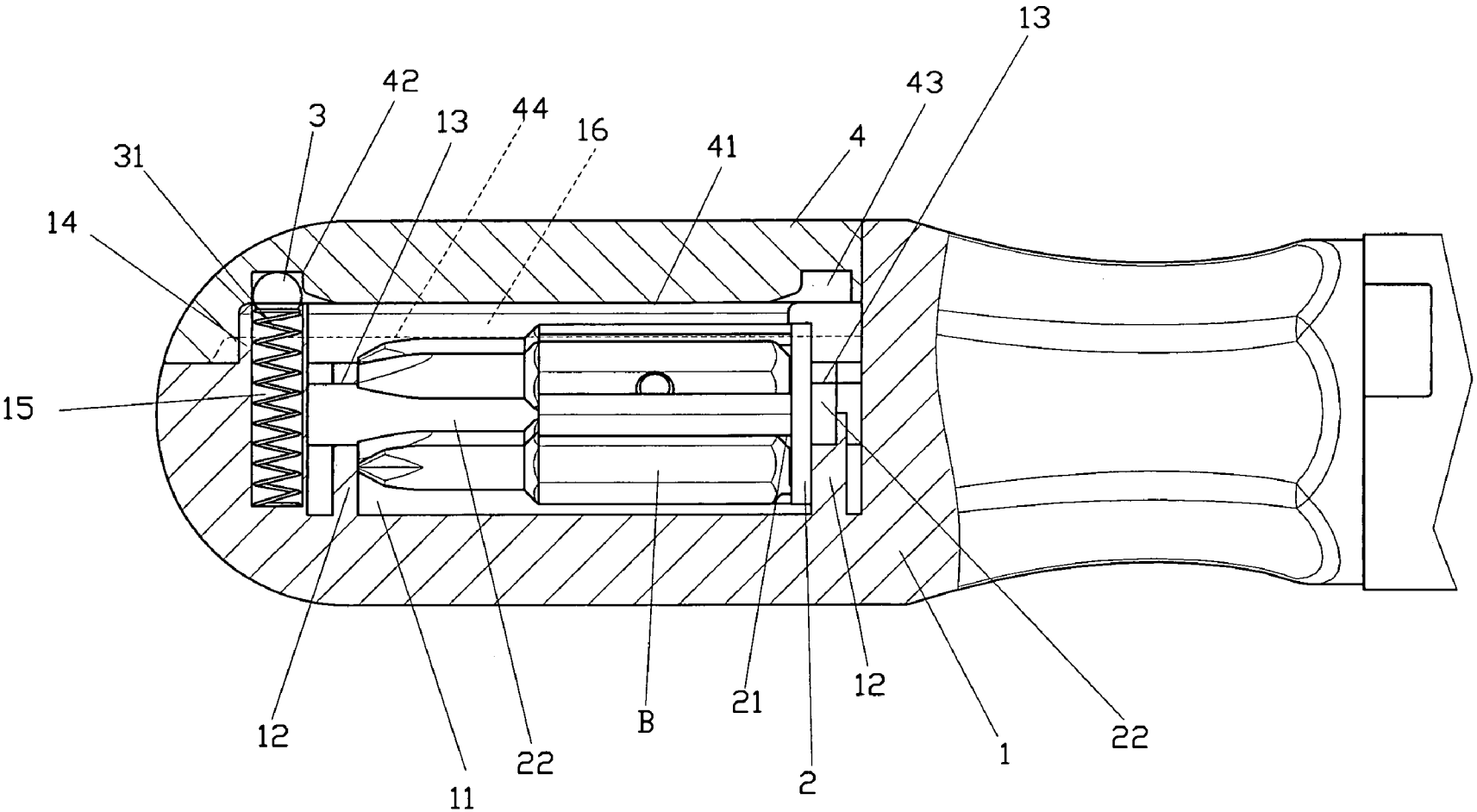
FIG. 2 is a side view of the present invention, partially sectioned.

To assemble the present invention, as shown in FIG. 2, screwdriver heads B are inserted into the recesses 21 of the receiving unit 2. The stems 22 of the receiving unit 2 are engaged with the troughs 13 of the connecting blocks 12 of the handle 1, so that the receiving unit 2 is free to turn in the compartment 11. The clamping device 3 with the elastic element 31 is placed into the blind hole 15 of the locator 14 of the handle 1. The second sliding sections 44 of the sliding cover 4 are engaged with the first sliding sections 16 of the handle 1 to cover the compartment 11. The locator 14 of the handle 1 is inserted into the slot 41 of the sliding cover 4, so that the sliding cover 4 is able to slide on the handle 1. The clamping device 3 is inserted into the locating hole 42 of the sliding cover 4 to secure the sliding cover 4 in place and to cover the compartment 11.

Figure 3:
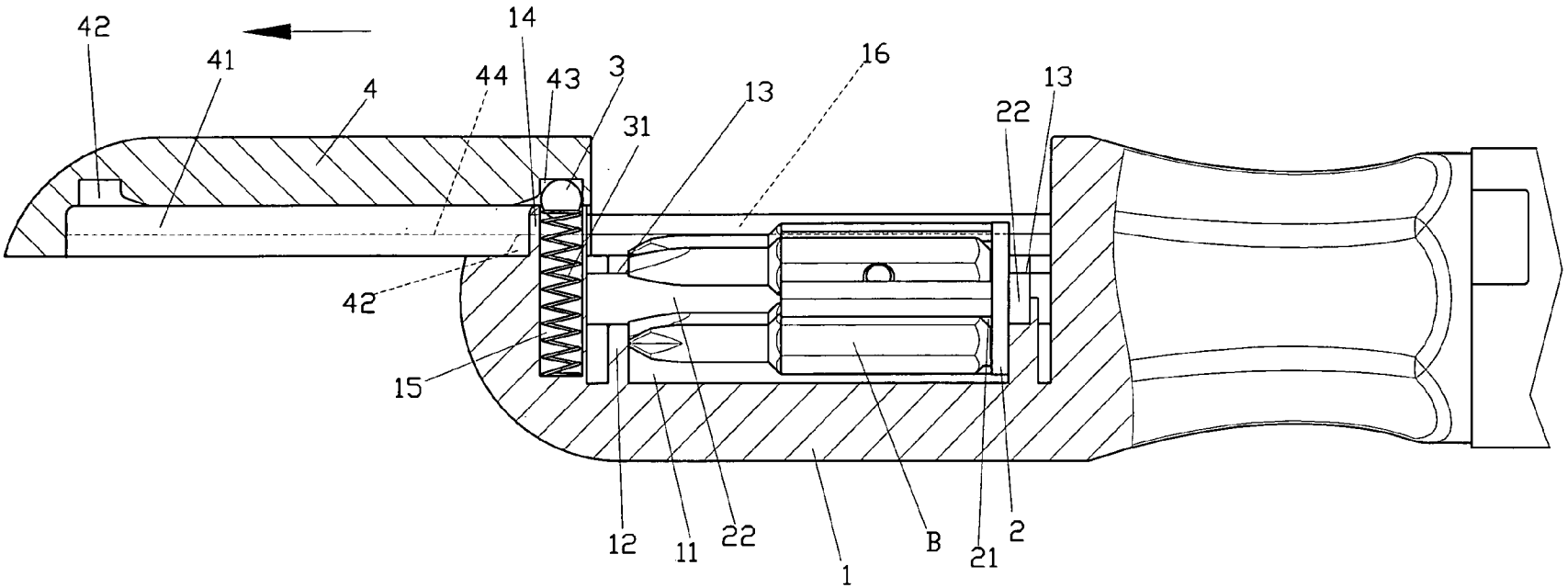
FIG. 3 is a view similar to FIG. 2 showing a sliding cover in an open status.
Figure 4:
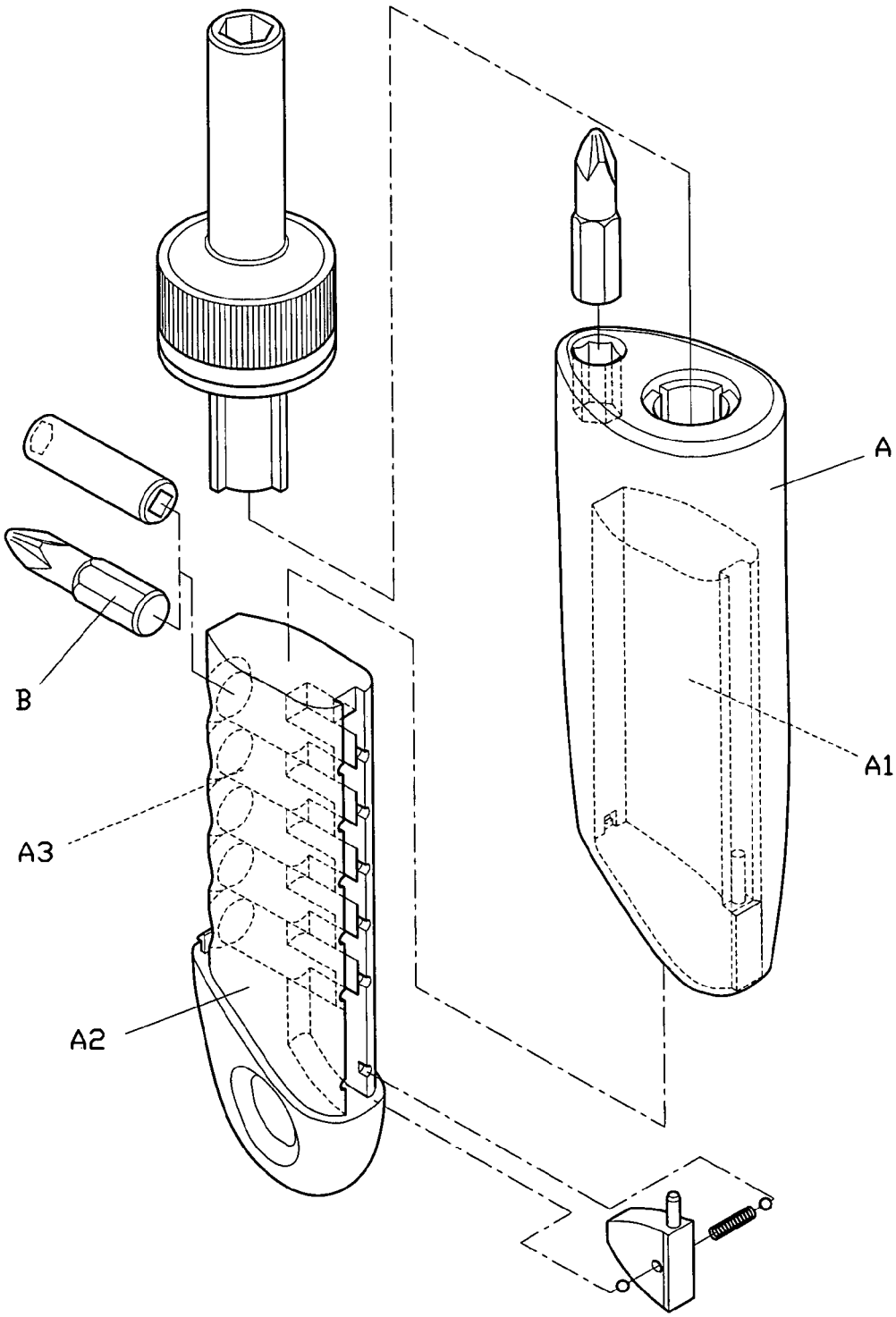
F I G . 4 (PRIOR ART)
FIG. 4 is an exploded view of a prior art.

To operate the present invention, as shown in FIG. 3, the sliding cover 4 is pushed backward with the second sliding sections 44 of the sliding cover 4 sliding along the first sliding sections 16 of the handle 1, while the clamping device 3 is departed from the locating hole 42 of the sliding cover 4. When the sliding cover 4 is pushed to another end of the handle 1, the clamping device 3 is inserted into the other locating hole 43 of the sliding cover 4 and the sliding cover 4 is secured in place. The user may pick a desired screwdriver head B, and then push the sliding cover 4 forward to cover the compartment 11.

Because the receiving unit 2 is pivotally connected to the compartment 11, the receiving unit 2 is free to rotate in the compartment 11 when choosing a desired screwdriver head B.

I claim:

1. A screwdriver with screwdriver head storage structure comprising:

a handle, said handle comprising a compartment therein, wherein said handle comprises a pair of first sliding sections at respective sides of said compartment and a sliding cover to cover said handle, said sliding cover comprising a pair of second sliding sections to engage with said first sliding sections of said handle, said compartment comprising a pair of connecting blocks therein, said connecting blocks comprising troughs thereon, wherein said compartment comprises a locator protruding from one end, said locator comprising a blind hole to accommodate a clamping device therein, said sliding cover comprising locating holes at front and rear ends to accommodate said clamping device when said sliding cover slides along said handle;

a receiving unit, said receiving unit comprising a plurality of recesses and a pair of stems at respective ends to engage with said troughs of said connecting blocks of said handle.

2. The screwdriver with screwdriver head storage structure, as recited in claim 1, wherein said first sliding sections of said handle are sliding blocks, and said second sliding sections of said sliding cover are sliding troughs.

* * * * *